US006578307B2

(12) United States Patent
Troyer

(10) Patent No.: US 6,578,307 B2
(45) Date of Patent: Jun. 17, 2003

(54) LOCK ACCESSORY FOR LEVER ACTION RIFLES

(76) Inventor: Cyprian Richard Troyer, 3014 Pennsylvania Ave. South, St. Louis Park, MN (US) 55426-3245

( * ) Notice: Subject to any disclaimer, the term of this patent is extended or adjusted under 35 U.S.C. 154(b) by 0 days.

(21) Appl. No.: 09/783,165

(22) Filed: Feb. 15, 2001

(65) Prior Publication Data

US 2002/0116856 A1 Aug. 29, 2002

(51) Int. Cl.[7] ..... F41A 17/46
(52) U.S. Cl. ..... 42/70.06; 42/70.11
(58) Field of Search ..... 42/70.11, 70.07, 42/70.06

(56) References Cited

U.S. PATENT DOCUMENTS 4,398,367 A * 8/1983 Gamble et al.
5,313,733 A * 5/1994 Meade
5,437,119 A * 8/1995 Womack
5,621,996 A * 4/1997 Mowl, Jr.
5,768,819 A * 6/1998 Neal
5,960,575 A * 10/1999 Chiovitt et al.
6,009,654 A * 1/2000 Williams et al.
6,142,313 A * 11/2000 Young
6,260,299 B1 * 7/2001 Jordan

FOREIGN PATENT DOCUMENTS

DK 7800 * 3/1950

* cited by examiner

*Primary Examiner*—Michael J. Carone
*Assistant Examiner*—Troy Chambers

(57) ABSTRACT

A device for the securing of a lever action rifle against unauthorized use composed of a fitted, hinged enclosure. The enclosure is closely fitted to the contours and requirements of individual rifle models. As an adjunct to trigger guard style locks, it contains no locking mechanism. It extends the applicability of that style lock by providing for the securing of the rifles operating lever, at the same time permitting the trigger guard style lock to be applied in the usual way.

1 Claim, 4 Drawing Sheets

VIEW INCLUDING COMBINATION STYLE TRIGGER LOCK

1 CONTINUOUS STYLE FIXED PIN HINGE

2 THROUGH HOLE FOR TRIGGER LOCK

3 THROUGH HOLE FOR CABLE LOCK

1 CONTINUOUS STYLE FIXED PIN HINGE

CUTAWAY VIEW SHOWING ACCESSORY MOUNTED TO RIFLE

VIEW INCLUDING COMBINATION STYLE TRIGGER LOCK

LOCK ACCESSORY FOR LEVER ACTION RIFLES

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

This invention pertains to the field of firearms security, specifically the secure storage of lever action rifles. There are many trigger guard style locks available, but all of these designs rely on the immobility of the trigger guard as the foundation of the security of the device. Lever action rifles are inherently difficult to secure due to the integration of the operating lever and trigger guard. As the lever can be moved away from the trigger to cycle the action, the trigger guard style lock is rendered useless unless something else prevents motion of the lever. Previous patents for enclosure type locking devices, ie. Meade (U.S. Pat. No. 5,313,733) do not address the need for the enclosure to be fitted to the specific form and requirements of specific models of rifle. Each rifle design is different, and they have unique needs, such as to cover and protect takedown screws or to avoid interference with different operating parts. In attempting to be universally applicable, Meade's patent forces compromises in security when applied to any individual rifle. Further, other enclosure type security devices, ie. Jordan (U.S. Pat. No. 6,260,299B1) render the enclosure too large and bulky for convenient use by integrating the lock mechanism into the enclosure, or by attempting to anticipate the needs of too many different configurations of firearm.

BRIEF SUMMARY OF THE INVENTION

This invention comprises a hinged enclosure, closely fitted to the contour of the stock and combination lever and trigger guard of certain common lever action rifles and provided with an opening to allow fitment of a trigger lock. Properly applied, the trigger lock secures the invention to the rifle, which in turn secures the lever. This effectively locks the action in the closed position without interfering with the internal portions of the action. In the closed position, the action is protected from tampering and the entry of contamination. The enclosure also includes provision for threading a cable style lock through the enclosure and the rifle's lever loop, allowing the user to lock the firearm to any convenient, secure location. Thus, the rifle may be secured against theft, tampering, and unauthorized use. The enclosure fits closely enough that it does not interfere with or risk damaging common accessories, and takes up so little space that it does not complicate the packaging of the secured firearm in common rifle cases for transport. This invention is not intended to render any firearm foolproof or failsafe in any way, only to allow conscientious users to enjoy the benefits of readily available trigger locks without undue complication or inconvenience.

DETAILED DESCRIPTION OF THE INVENTION

Figure 1:
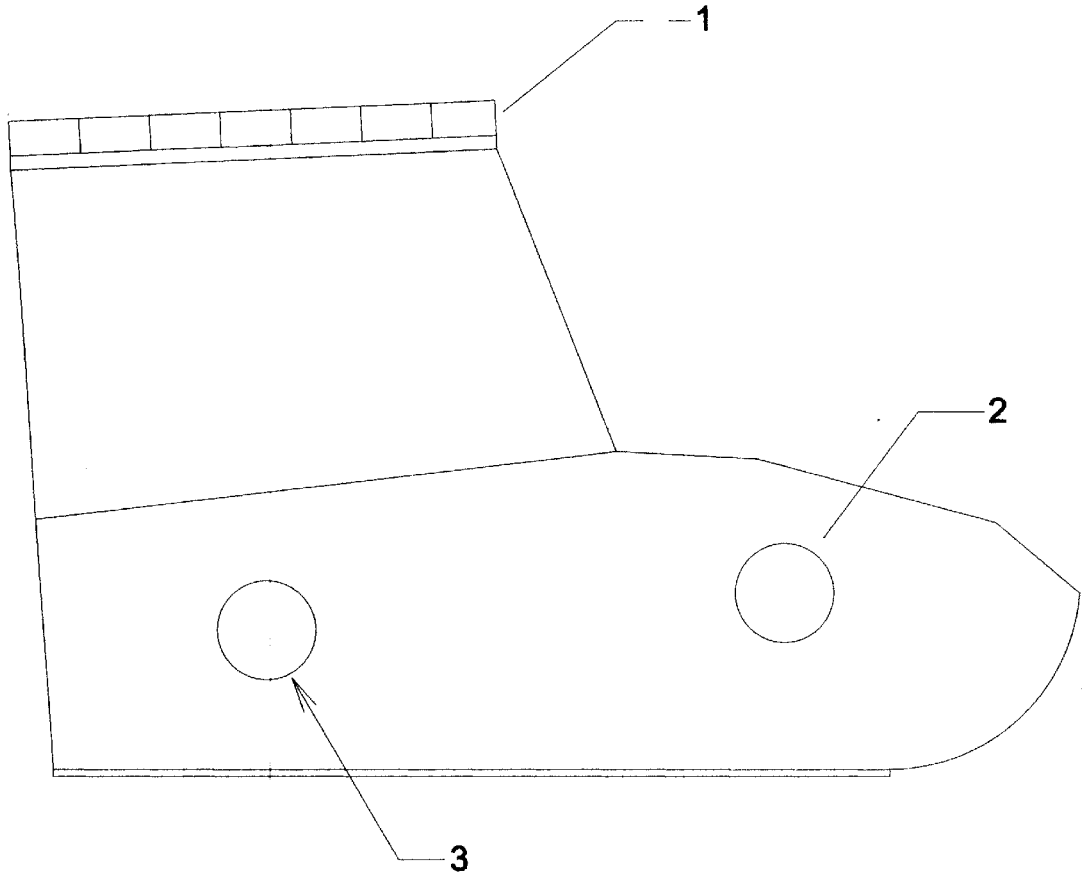
FIG. 1 represents a side view of the lock accessory assembly.
Figure 2:
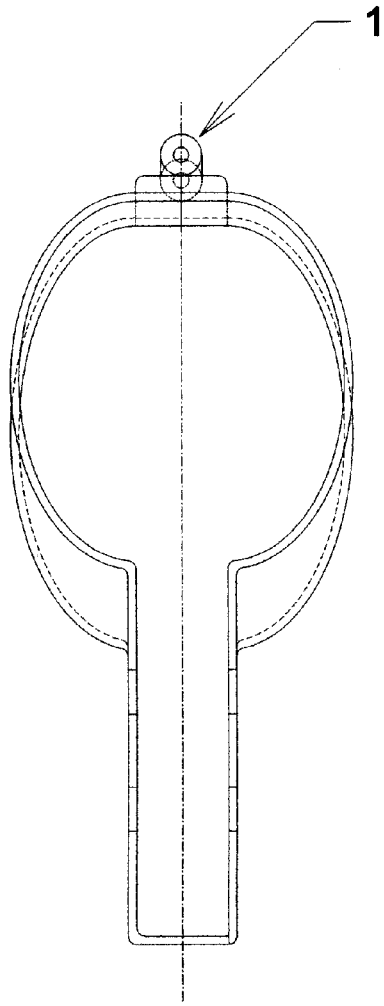
FIG. 2 represents a front view of the lock accessory assembly.
Figure 3:
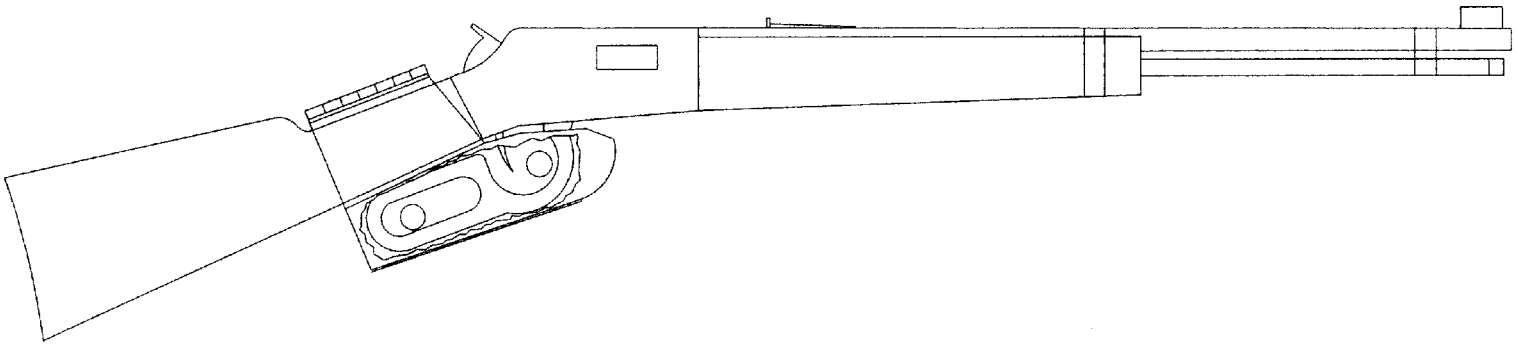
FIG. 3 represents a cutaway view of the lock accessory assembly mounted to a rifle.
Figure 4:
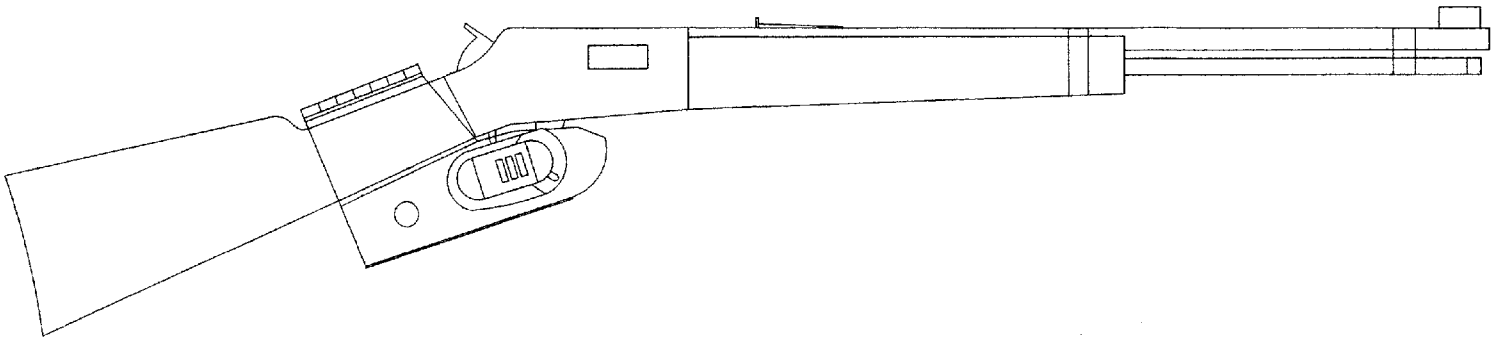
FIG. 4 represents a side view of the lock assembly mounted to a rifle and in combination with a combination style trigger lock.

The lock accessory consists of a hinged enclosure, closely fitted to the specific contours of the stock and combination lever and trigger guard of a lever action rifle and provided with openings to allow fitment of a trigger lock and secondary securing to a substrate.

The body of the enclosure is to be constructed of heavy gauge sheet steel, cut and formed to the required shape. The two halves are joined across the top junction with a suitably durable hinge (1), providing freedom of movement to remove the enclosure when the separate trigger lock is removed. Such a hinge also prevents tampering by defeating the hinge, ie., by removing the hinge pin. The hinge may be either welded in place, or formed as an integral portion of the enclosure.

When installed on a rifle, which should preferably be stored with the magazine and chamber empty, the two halves of the enclosure fit around the stock and lever to deny access to the lever, and such that a tab at the lever side of one half restricts the normal travel of the lever. A common post style trigger lock is then fitted through the provided holes (2) in each half. This secures the enclosure to the lever assembly, preventing movement of the lever. In turn, the now secured lever and enclosure holds the trigger lock in place on the rifle. Thus, it is not possible for unauthorized users to cycle the action or remove the trigger lock. Depending on the specific design of individual rifles, it may still be possible to feed ammunition into the magazine, or to cock the hammer; however, since the lever and trigger are secured, it will not be possible to chamber ammunition, or to operate the trigger normally to fire the rifle.

The enclosure may also be separately secured through some secondary means, ie., a cable or padlock type lock through holes (3) to secure the firearm in place.

In order to prevent damage to the firearm being secured, as well as those in close proximity, ie., storage or transport, the enclosure is to be either coated with a rubberized type coating or lined with some appropriate cushioning material, ie., adhesive backed felt.

There are currently available locking enclosures intended to secure handguns from unauthorized use, but these are designed to enclose substantially all of the operating portions of a handgun. This renders such designs ineffective for application to lever action rifles. Further, their substantial bulk precludes their use when a rifle is packed in common rifle cases for transport.

The enclosure is to be designed for application to specific models of rifle, with variations of size and form to accommodate the differing requirements of different models with minimal bulk, thus maximizing the convenience of use.

What is claimed is:

1. I claim a safety device for lever action rifles composed of a hinged or flexible enclosure surrounding and closely fitted to the stock, action, and lever portion of a rifle, in combination with a separate trigger guard type gun lock, said enclosure being provided with holes to permit the application of said trigger guard type gun lock and also to permit further securing of the rifle with any other type of appropriate locking or restraining device.

* * * * *